United States Patent [19]

Iwata

[11] Patent Number: 5,012,899

[45] Date of Patent: May 7, 1991

[54] APPARATUS FOR CONTROLLING AN ELEVATOR

[75] Inventor: Shigemi Iwata, Inazawa, Japan

[73] Assignee: Mitsubishi Denki Kabushiki Kaisha, Japan

[21] Appl. No.: 342,896

[22] Filed: Apr. 25, 1989

[30] Foreign Application Priority Data

Apr. 26, 1988 [JP] Japan ..... 63-101392

[51] Int. Cl.[5] ..... B66B 1/00

[52] U.S. Cl. ..... 187/101

[58] Field of Search ..... 187/101, 124, 130

[56] References Cited

U.S. PATENT DOCUMENTS 4,367,810 1/1983 Doane et al. ..... 187/101 X
4,787,481 11/1988 Farrar et al. ..... 187/101 X
4,838,385 6/1989 Ekholm ..... '87/'101

FOREIGN PATENT DOCUMENTS 60-223771 11/1985 Japan .

*Primary Examiner*—J. R. Scott
*Assistant Examiner*—W. E. Duncanson, Jr.
*Attorney, Agent, or Firm*—Leydig, Voit & Mayer

[57] ABSTRACT

An apparatus for controlling an elevator according to the present invention has a master microcomputer having a plurality of slave microcomputers and memory means for storing in advance at least one of control data and control program necessary for the slave microcomputers, and transmitting means connected between the master microcomputer and a plurality of slave microcomputers for individually transmitting at least one of the control data and control program from the master microcomputer to the respective slave microcomputers.

5 Claims, 5 Drawing Sheets

APPARATUS FOR CONTROLLING AN ELEVATOR

BACKGROUND OF THE INVENTION

The present invention relates to an apparatus for controlling an elevator under a distributed control by a plurality of microcomputers and, more particularly, to an apparatus for controlling an elevator which eliminates a regulating unit.

A plurality of microcomputers are employed in an apparatus for controlling an elevator in accordance with the recent development of microelectronics.

Two microcomputers are employed in a conventional apparatus for controlling an elevator disclosed, for example, in Japanese Patent Application No. 59-77798 specification (Japanese Patent Application Laid-open No. 60-223,771), wherein one of the microcomputers has a sequence for starting, running, and stopping elevator cages and generating a normal speed command signal, while the other has functions of controlling the speeds of cages and generating a terminating floor deceleration command signal. In other words, the controlling functions of the elevator are distributed by a plurality of microcomputers.

FIG. 4 is a view of the entire arrangement of the conventional apparatus for controlling an elevator as described above. A rope 1 is engaged with a sheave 2, and a cage 3 is hung from one end of the rope 1 and a counterweight 4 is hung from the other end of the rope 1. An induction motor (IM) 5 is coupled through a shaft, shown, with the sheave 2 to drive it. A pulse generator (PG) 6 is coupled through a shaft with the motor 6 to generate pulses proportional to the moving distance of the cage 3 by the rotation of the motor. A counter 7 is electrically connected to the pulse generator 6 to count the number of pulses proportional to the number of revolutions of the motor from the pulse generator 6. A microcomputer system 8 inputs the pulse counted value 7*a* of the counter 7 and counts in a predetermined manner. A power converter 9 converts 3-phase a.c. from a 3-phase a.c. power supply 10 into power adapted for controlling an elevator speed. A command signal 8*a* is applied from the microcomputer system 8 to the power converter 9 to control the torque and the rotating speed of the motor 5. A terminating position detector 11 is provided in an elevator shaft (not shown) near a terminating floor 12 to generate an output signal 11*a* in cooperation with a cam 13 attached to the cage 3. The output signal 11*a* is inputted to the microcomputer system 8.

FIG. 5 is a block diagram showing the detail of a microcomputer system for use in the microcomputer system 8 as shown in FIG. 4. The microcomputer system 8 has a first microcomputer 80 and a second microcomputer 90. The first microcomputer 80 has a CPU 81, a ROM 83, a RAM 84, a regulating unit 85 to be described in detail later, an input port 86 and an output port 87 connected through a bus 82 to the CPU 81. The pulse counted value 7*a* of the counter 7 is inputted to the input port 86. The first microcomputer 80 sequentially calculates the running direction command, starting, running and stopping commands as well as generating the normal speed command signal of the cage 3.

The second microcomputer 90 has, similar to the first microcomputer 80, a CPU 91, a ROM 93, a RAM 94, a regulating unit 95, an input port 96 and an output port 97 connected through a bus 92 to the CPU 91. The pulse counted value 7*a* of the counter 7 and the output signal 11*a* of the terminating position detector 11 are inputted to the input port 96. The second microcomputer 90, when the normal speed command signal formed in the first microcomputer 80 is inputted, obtains a deviation from the pulse counted value 7*a* (i.e., a cage speed signal) proportional to the rotating speed of the motor 5, calculates (feedback calculates) a command to an exterior in accordance with the deviation, and generates a command signal 8*a* for controlling the rotating speed and the torque of the motor 5. The second microcomputer 90, inputs, when the cage 3 approaches the terminating floor 12, the output signal 11*a* of the terminating position detector 11, and executes the generation of a terminating floor deceleration command signal.

The above-described normal speed command signal calculated by the first microcomputer 80 is inputted to the CPU 91 of the second microcomputer 90 through a transmission interface (I/F) 100 for connecting the CPU 81 in the first microcomputer 80 to the CPU 91 in the second microcomputer 90. The command signal 8*a* generated in the CPU 91 is outputted through the output port 97 to the power converter 9.

The regulating units 85 and 95 externally set the set values and the regulating values of the first and second microcomputers 80 and 90, respectively, and are composed of rotary switches, dip switches or jumper plugs (not shown).

For example, the regulating unit 85 sets the acceleration and deceleration of a normal speed command signal, a rated speed, the number of stops of a building, a power supply frequency and/or the motor output of an elevator for the first microcomputer 80. The regulating unit 95 sets an acceleration at the time of decelerating, the terminating floor deceleration command signal, a rated speed, a power supply frequency, a motor output and/or the gain value of a feedback calculation for the second microcomputer 90. These set values and regulating values are not determined at the time of manufacture of the elevator but are set by an installation technician for the building into which it is to be installed. Particularly, the gain value and the acceleration of the feedback calculation are regulated by the installation technician while observing the riding comfort and the cage positioning accuracy at the floor of the elevator after installation.

Even if the conventional apparatus for controlling the elevator employs two microcomputers, the regulating units must be provided in the respective microcomputers, and it is economically disadvantageous.

The present invention has been made in view of the disadvantages described above, and has for its object to provide an apparatus for controlling an elevator which is inexpensive without need for a regulating unit.

SUMMARY OF THE INVENTION

The apparatus for controlling the elevator according to the present invention comprises a master microcomputer having a plurality of slave microcomputers, and memory means for storing in advance at least one of control data and control program necessary for the slave microcomputers, transmitting means connected between the master microcomputer and said plurality of slave microcomputers for individually transmitting at least one of said control data and control program from said master microcomputer to said respective slave microcomputers.

In the present invention, the above-described regulating units are removed from the apparatus. Insteads, the functions to be regulated are concentrated in the master microcomputer, where necessary set values and regulating values are transmitted from the master microcomputer to the slave microcomputers.

BRIEF DESCRIPTION OF THE DRAWINGS

In the drawings, the same symbols indicate the same or corresponding parts.

DESCRIPTION OF THE PREFERRED EMBODIMENTS

An embodiment of the present invention will be described with reference to the accompanying drawings.

Figure 1:
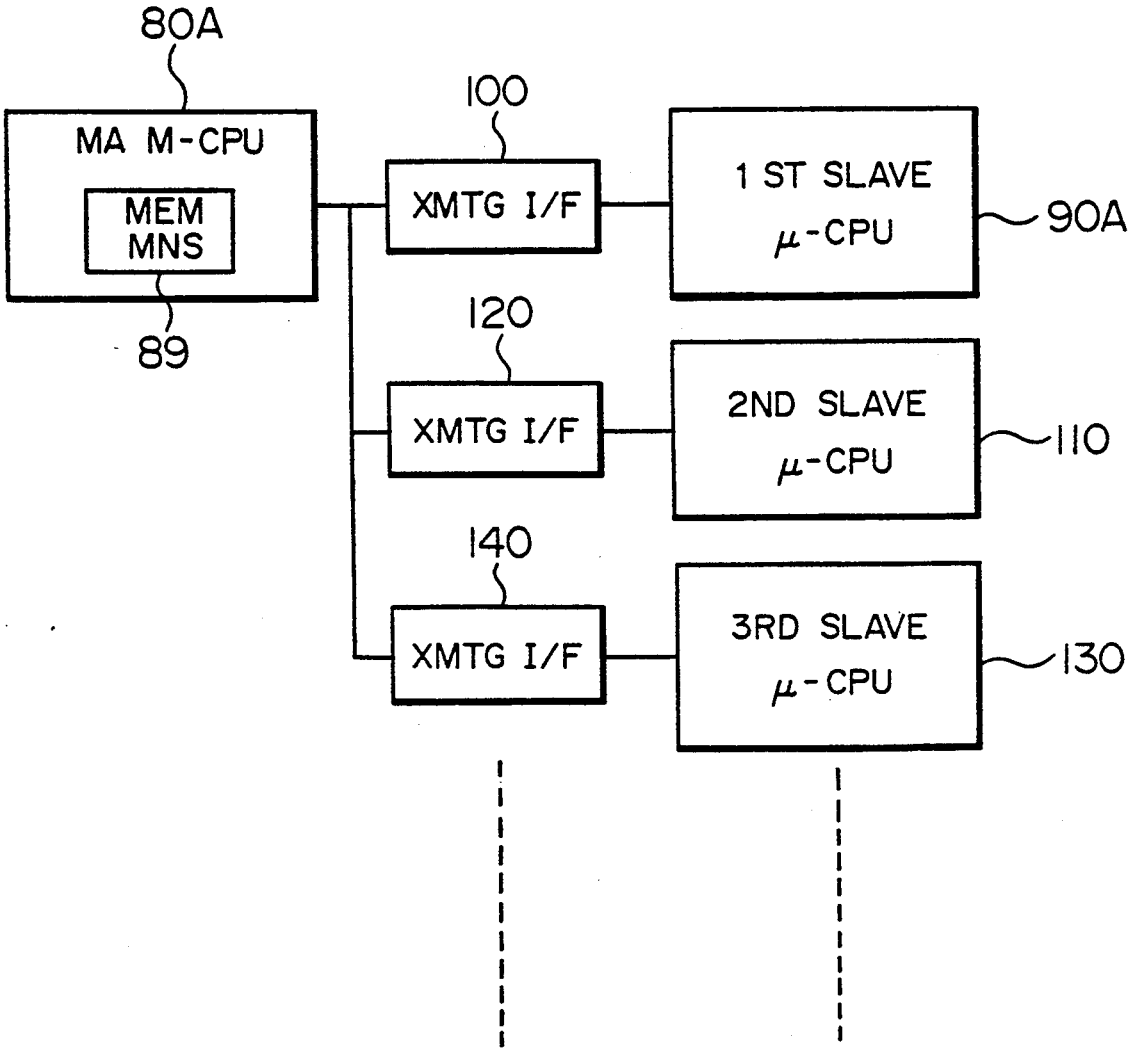
FIGS. 1 and 2 are views of an embodiment of the present invention.
Figure 5:
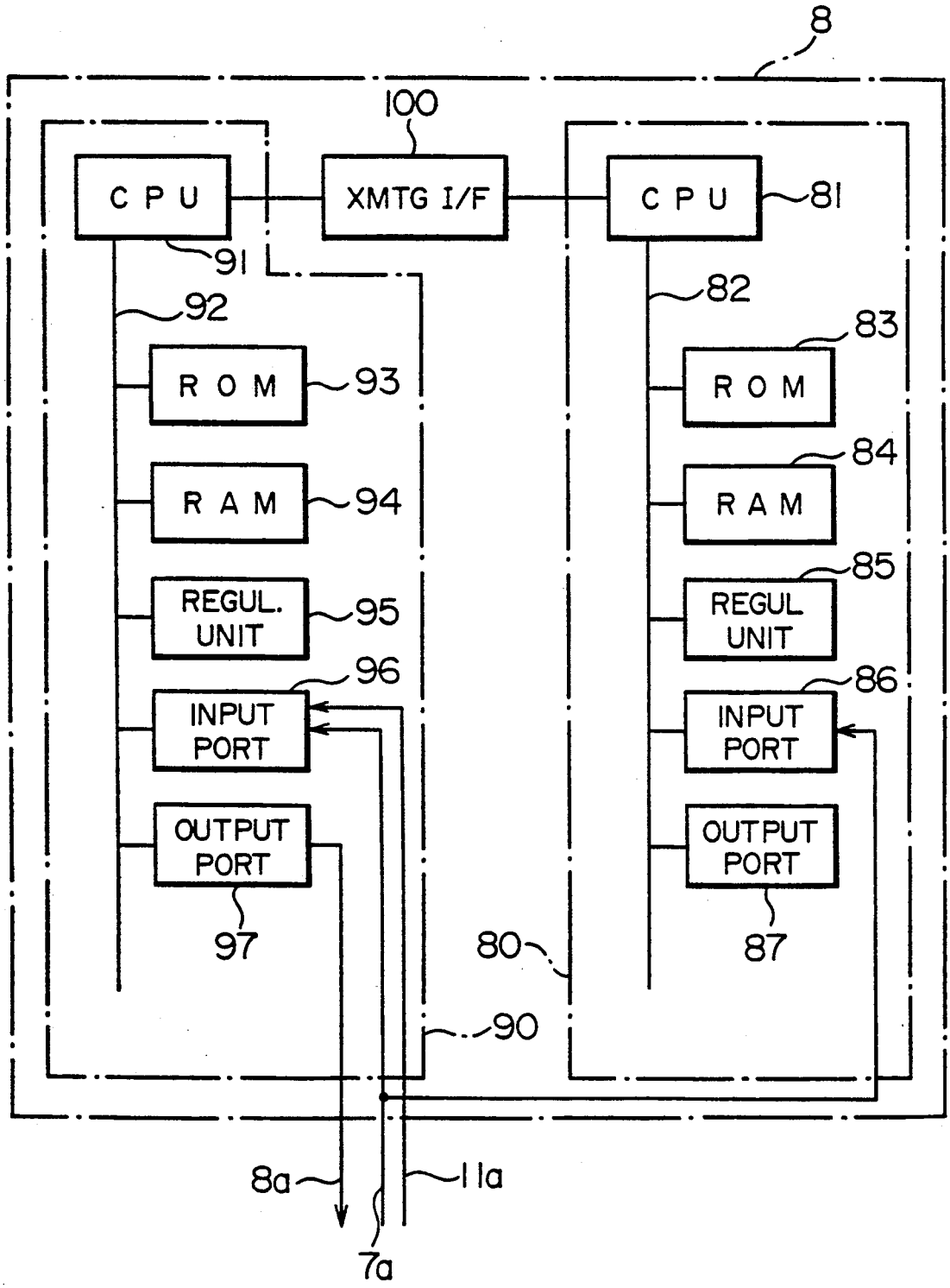
FIG. 5 PRIOR ART
FIG. 5 is a detailed block diagram of a microcomputer system for use in the conventional apparatus.

FIG. 1 shows an embodiment of an apparatus for controlling an elevator according to the present invention. In FIG. 1, a master microcomputer 80A corresponding to the first microcomputer 80 in FIG. 5 is coupled through transmitting interfaces 100, 120, 140, etc. as transmitting means with a plurality of microcomputers, such as first slave microcomputer 90A corresponding to the second microcomputer 90 of FIG. 5, a second slave microcomputer 110 provided in a hall to be described later, and a third slave microcomputer 130 provided in a cage to be described later. The master microcomputer 80A has memory means 89 to be described in detail later, which means 89 stores not only normal necessary control data but set values and regulating values necessary for the respective slave microcomputers, and transmits the values from the master microcomputer 80A to the respective slave microcomputers when necessary. It is noted that the memory means 89 may store the control program of the respective slave microcomputers.

Figure 2:
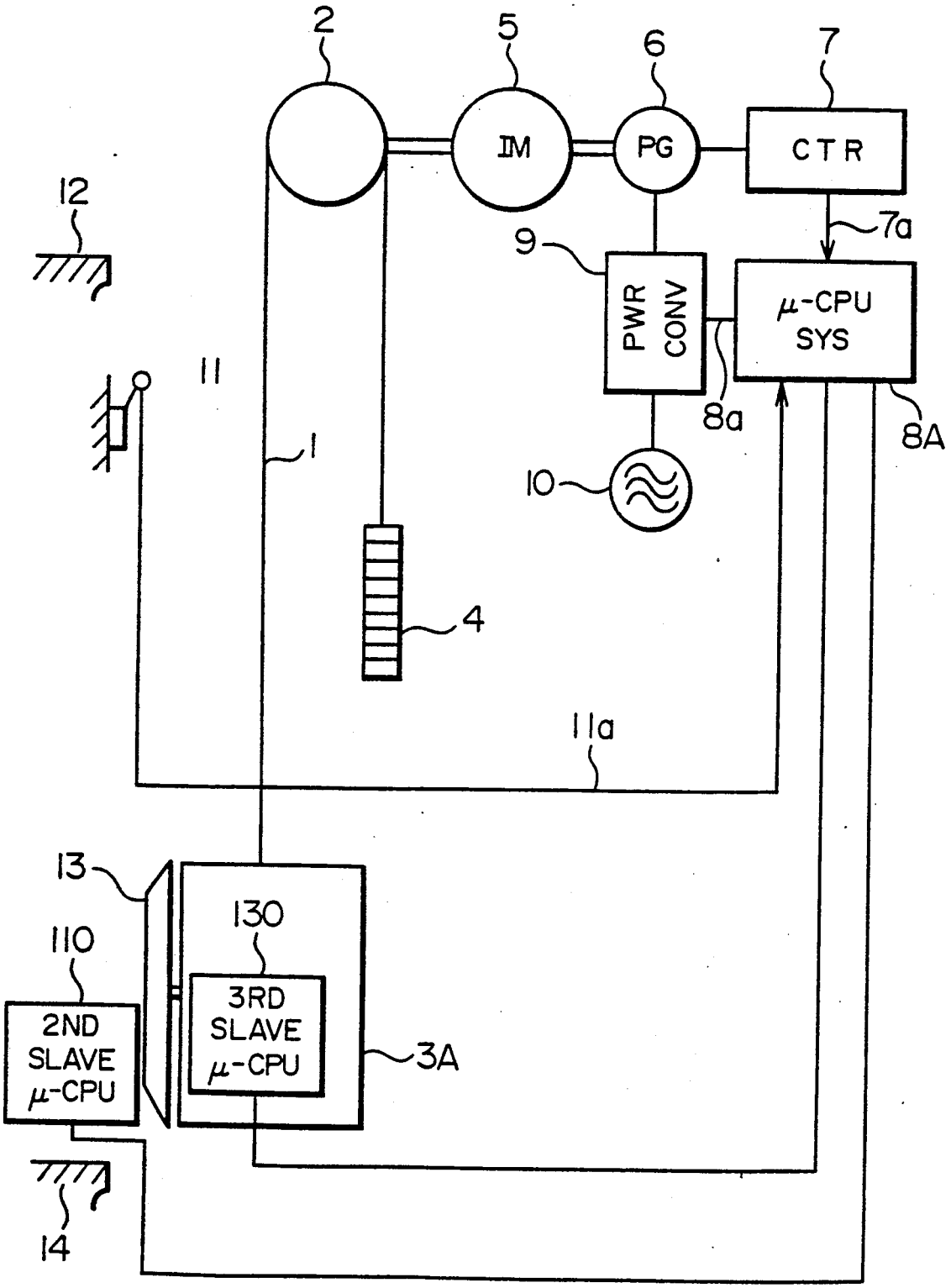
Figure 3:
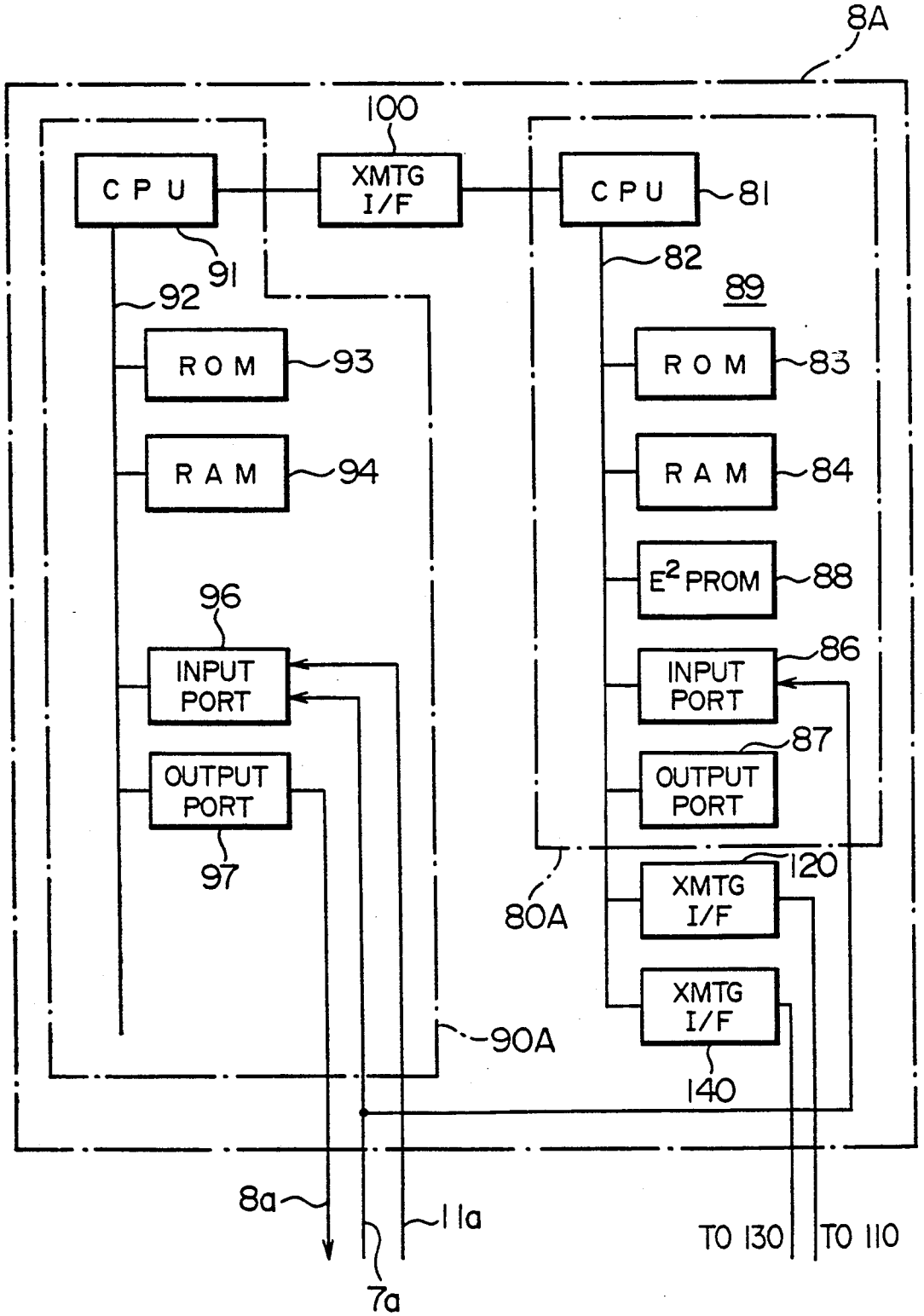
FIG. 3 is a detailed block diagram of a microcomputer system for use in the present invention.
Figure 4:
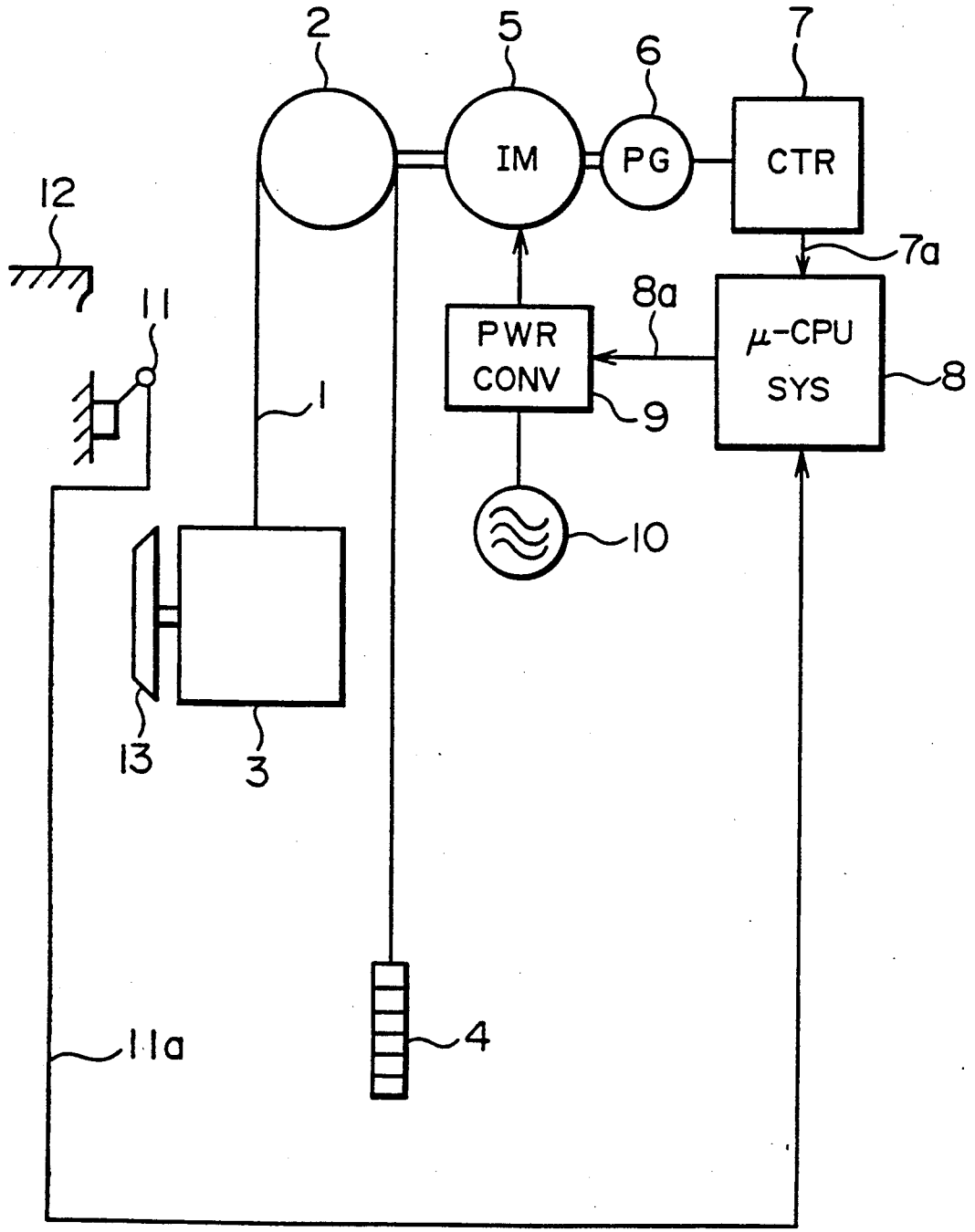
FIG. 4 PRIOR ART
FIG. 4 is a view of conventional apparatus for controlling an elevator.

FIG. 2 is a view of the entire arrangement of an embodiment of the present invention, wherein the same components as those in FIG. 4 indicate the same or equivalent components, i.e., the components 1, 2 4 to 7 and 9 to 13 denote the same components. In the embodiment in FIG. 2, a cage 3A has a third slave microcomputer 130 provided therein. The third slave microcomputer 130 executes the functions of displaying using an indicator (not shown) in the cage 3A, registering/cancelling the cage call (not shown) of the cage 3A, and detecting the open/close of the door (not shown) of the cage 3A. A second slave microcomputer 110 is provided in the hall of a certain floor 14, and this second slave microcomputer 110 carries out the functions of displaying using a hall indicator (not shown), and registering/cancelling a cage call (not shown). Further, the detail of the microcomputer system 8A for use in the embodiment in FIG. 2 is shown in the block diagram of FIG. 3. The microcomputer system 8A has a master microcomputer 80A and a first slave microcomputer 90A, the master microcomputer 80A has, in addition to the CPU 81, a bus 82, a ROM 83, a RAM 84, an input port 86 and an output port 87 as shown in FIG. 5, an $E^2$PROM 88 (a changeable electrically erasable programmable read-only memory).

The $E^2$PROM 88 stores set values and regulating values necessary for the master microcomputer 80A, such as the above-described acceleration/deceleration of the normal speed command signal, rated speed, the number of stops of a building, a power supply frequency and a motor output as well as set values and regulating values necessary for the first slave microcomputer 90A, such as the above-described acceleration at the time of decelerating the terminating floor deceleration command signal, rated speed, power supply frequency, motor output and the gain value of a feedback calculation, etc. The ROM 83, the RAM 94 and the $E^2$PROM 88 constitute memory means 89 in FIG. 1. The first slave microcomputer 90A is entirely the same as the second microcomputer 90*a* of FIG. 5 except for the regulating unit 95 from the second microcomputer 90A. Control data necessary for the first slave microcomputer 90A is sequentially transmitted to the $E^2$PROM 88, the CPU 81, the transmitting interface 100, the CPU 91 and the RAM 94 in this order, and used at a timing necessary for the first slave microcomputer 90A. The control data stored in the $E^2$PROM 88 can be freely rewritable in a site of a building by an installation technician using a hand-held computer (not shown), for example, through an RS-232-C interface (not shown).

The control data normally necessary to be transmitted between the master microcomputer 80A and the second slave microcomputer 110 installed in the hall 14 through transmitting interface 120 include the present floor (the floor to be displayed on an indicator) of the elevator, and registering/cancelling signal of the hall button. The set values and the regulating values to be transmitted from the $E^2$PROM 88 in the master microcomputer 80A to the second slave microcomputer 110 include the number of stops of a building, and a floor not served according to a time zone. If the present invention is not employed to obtain these values, the regulating unit as shown in FIG. 5 must be installed in the second slave microcomputer 110. The control data normally necessary to be transmitted between the master microcomputer 80A and the third slave microcomputer 130 installed in the cage 3A through the transmitting interface 140 include the present floor (the floor to be displayed on the indicator) of the elevator, registering/cancelling signal of the cage button, and door open/close command, etc. The set values and regulating values to be transmitted from the $E^2$PROM 88 in the master microcomputer 80A to the third slave microcomputer 130 include the number of stops of a building, a floor not served according to a time zone, and a door motor control value. If the present invention is not employed to obtain them, the above-mentioned regulating unit must be installed in the third slave microcomputer 130.

In the embodiment described above, the $E^2$PROM is employed instead of the regulating unit. However, nonvolatile readable/writable memory means of combinations of a RAM and a battery or a RAM and a capacitor may be employed. The control programs of the respective slave microcomputer are stored in the $E^2$PROM, and may be transmitted to the respective slave microcomputers. Since the control program of the slave microcomputer can be modified by operating only the master microcomputer in a machine room if the control programs of the respective slave microcomputers are desirably modified after the elevator is installed in the building with this arrangement, the labor of the installation technician can be eliminated. If not, the ROM in which the control programs of the respective slave microcomputers are written must be replaced by making the technician move to the hall or the cage.

As described above, the present invention comprises the master microcomputer having a plurality of slave microcomputers, and the memory means for storing in advance at least one of control data and control program necessary for the slave microcomputers, and transmitting means connected between the master microcomputer and said plurality of slave microcomputers for individually transmitting at least one of said control data and control program from said master microcomputer to said respective slave microcomputers. Therefore, (I) the set values and the regulating values of the slave microcomputers are stored in the memory means of the master microcomputer, but they are not stored in the slave microcomputers. Since (II) the slave microcomputers employ the set values and the regulating values transmitted from the master microcomputer, the regulating unit is not required for the slave microcomputers making them inexpensive, and the data can be managed centrally by the master microcomputer.

What is claimed is:

1. An apparatus for controlling an elevator under a distributed control by a plurality of microcomputers comprising:

a master microcomputer and a plurality of slave microcomputers, said master microcomputer including a microprocessor and memory which stores control data representing regulating and set values and control programs for the slave microcomputers, each of said slave microcomputers including a slave system memory which can receive and store a control program and the control data received from said master microcomputer, transmitting means connected between said master microcomputer and each of said plurality of slave microcomputers for transmitting control data and control programs from said master microcomputer memory to said respective slave microcomputers to be stored in said slave system memories.

2. An apparatus for controlling an elevator under a distributed control by a plurality of microcomputers comprising:

a master microcomputer and a plurality of slave microcomputers, said master microcomputer including a microprocessor and memory which stores control data representing regulating and set values for the slave microcomputers, each of said slave microcomputers including a slave system memory which can receive and store the control data received from said master microcomputer, transmitting means connected between said master microcomputer and each of said plurality of slave microcomputers for transmitting the control data from said master microcomputer memory to said respective slave microcomputers to be stored in said slave system memories.

3. An apparatus according to claim 2 wherein said regulating and set value relate to acceleration and deceleration of normal speed command signals, rated speed, number of floors to a building which are not determined until an elevator is installed in a building.

4. An apparatus according to 3 wherein said master microcomputer memory is a changeable memory so as to be freely rewritable by an installation technician.

5. An apparatus according to claim 3 wherein said changeable memory is an erasable programmable read-only memory.

* * * * *